US008992729B2

(12) United States Patent
Berg et al.

(10) Patent No.: US 8,992,729 B2
(45) Date of Patent: Mar. 31, 2015

(54) METHOD AND ARRANGEMENT FOR SEPARATING CONTAMINANTS FROM LIQUIDS OR VAPORS

(75) Inventors: Carl-Gustav Berg, Kauniainen (FI); Heikki Jaakkola, Helsinki (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 13/880,274

(22) PCT Filed: Oct. 17, 2011

(86) PCT No.: PCT/FI2011/050905

§ 371 (c)(1),
(2), (4) Date: Sep. 9, 2013

(87) PCT Pub. No.: WO2012/052619

PCT Pub. Date: Apr. 26, 2012

(65) Prior Publication Data

US 2013/0340960 A1 Dec. 26, 2013

(30) Foreign Application Priority Data

Oct. 18, 2010 (FI) ..... 20106079

(51) Int. Cl.
*D21C 11/00* (2006.01)
*D21C 11/06* (2006.01)
*D21C 11/10* (2006.01)

(52) U.S. Cl.
CPC ..... *D21C 11/0092* (2013.01); *D21C 11/06* (2013.01); *D21C 11/103* (2013.01)
USPC ..... 162/29; 425/255

(58) Field of Classification Search
CPC .... D21C 11/00; D21C 11/0007; D21C 11/06; D21C 11/066
USPC ..... 162/29
See application file for complete search history.

(56) References Cited

U.S. PATENT DOCUMENTS 5,759,345 A 6/1998 Bobik et al.
2005/0098037 A1 5/2005 Dietrich et al.

FOREIGN PATENT DOCUMENTS

WO 99/37853 A1 7/1999
WO 00/01879 A1 1/2000

OTHER PUBLICATIONS

European Search Report published in PCT/FI2011/050905 mailed Jan. 19, 2012.

*Primary Examiner* — Jacob Thomas Minskey
(74) *Attorney, Agent, or Firm* — Nixon & Vanderhye P.C.

(57) ABSTRACT

A method and assembly for separating contaminants from liquids, such as condensates, or vapors at an evaporation plant. The contaminants are separated from liquids by stripping when bringing a contaminant-enriched liquid into direct contact with a vapor by spraying or distributing the liquid into the vapor flowing in a vapor duct or onto wall surfaces in the vapor duct thus reducing the contaminant-content of the sprayed liquid and producing a cleaner liquid. The contaminants are enriched in the vapor. From vapors contaminants are separated by absorption when bringing a contaminant-enriched vapor into direct contact with a cleaner liquid by spraying or distributing the liquid into the vapor flowing in a vapor duct or onto wall surfaces in the vapor duct thus increasing the contaminant-content of the liquid, but producing a cleaned vapor.

27 Claims, 7 Drawing Sheets

METHOD AND ARRANGEMENT FOR SEPARATING CONTAMINANTS FROM LIQUIDS OR VAPORS

RELATED APPLICATIONS

This application is the U.S. national phase of International Application No. PCT/FI2011/050905 filed Oct. 17, 2011 which designated the U.S. and claims priority to FI 20106079 filed Oct. 18, 2010, the entire contents of each of which are hereby incorporated by reference.

TECHNICAL FIELD

The present invention relates to a method and arrangement for separating contaminants from liquids, such as condensates, or vapors in an evaporation plant.

BACKGROUND OF THE INVENTION

Methanol (MeOH) is one of the most important causes of chemical—(COD) and biological—(BOD) oxygen demand in biomass effluent streams or black liquor streams. Tightening environmental regulations make active methanol segregation and control essential. Alkaline cooking of wood chips at pulp mills forms normally 5-20 kg MeOH/t pulp, and methanol is hence found in varying amounts in all off-streams from the cooking plant, the most important being weak black liquor stream. Weak black liquor is an essential stream for producing reusable clean water because it simultaneously forms the key energy source in the pulp mill when it is concentrated by evaporation into so called firing black liquor and then burned in the recovery boiler. The modern recovery process can produce in a state of art pulp mill an excess of both heat and electricity.

The water removed from weak black liquor in the evaporation plant can contain a lot of volatile compounds like methanol, ethanol, acetone, turpentine and a number of sulphuric compounds. All these components are then partially contained in the firing black liquor but most of them are separated into secondary condensates and non-condensable off-gases.

Modern separation processes in evaporators have as a target to segregate secondary condensates so that most of the methanol is enriched in one relatively small condensate fraction (often called foul condensate), which can be purified with acceptable costs. The concentrated methanol and other volatile organic compounds can then be combusted in the recovery boiler, dedicated non-condensable gas incinerator or in the lime kiln. This, in turn, reduces the environmental impact of biomass-based methanol and also methanol accumulation when reducing fresh water consumption.

Modern pulp mills have a high degree of process integration, and black liquor evaporation is a very essential part of modern chemical-, water- and energy circulation. This has also been proven by modern pulp mills having a multi-effect evaporator train in the center of the pulp mill.

The black liquor evaporation plant typically comprises a multiple-effect evaporation plant with 3 to 7 effects (FIG. 1). Multiple-effect evaporation is in use in almost all sulphate pulp mills. The steam sequence is straight downstream. This is almost always the case. Live steam comes from the mill's low-pressure steam distribution system at a pressure of 0.35-0.45 MPa (absolute). This corresponds to a saturation temperature of 139° C.-148° C. The live steam is fed into the heating elements of the first effect (not shown in FIG. 1). Vapor generated in the liquor side of effect 1 is led through lines 15 into the heating elements of effect 2 and from there into effect 3 and so on as indicated by lines 16. Finally, vapor from the last effect 6 at a temperature of 57° C.-60° C. condenses in a surface condenser 8. In almost all cases the steam flow sequence is numbered so that it goes from effect 1 to next effect numbered as effect 2 and so on and the black liquor typically flows in the opposite direction. In FIG. 1 the heating element of the evaporators is a lamella formed of two plates attached to each other. Liquid to be evaporated is falling on the outer surface of the lamella, and a heating medium, such as vapor, flows inside the lamella. This is described in more detail in FIG. 2.

Several possibilities exist to arrange the liquor flow sequence in the evaporation plant. The optimum number of effects depends on the steam balance of the mill with boundary conditions like electricity production, electricity price, etc. Saving steam is not always economical and mill-wide cost calculations are needed to find out the best solution case by case. The application in FIG. 1 is typical for a northern pulp mill using softwood as raw material.

The concentrator effect 1 is usually divided into several subunits, which are parallel in the steam side and in series in the liquor side. For the liquor side the typical sequence is a backward- or mixed feed sequence. If the feed temperature is higher than the temperature in the last effect and the backward feed pattern is preferred, the liquor has to be flashed before feeding it to the last effect. The flashed steam from hot weak liquor is then mixed with suitable secondary steam flows giving latent heat to colder effects. The black liquor flow is indicated in FIG. 1. Weak black liquor (or other cellulose pulp waste liquor) in line 10 is fed into effect 4, where the liquor flashes. Then the liquor is passed via line 11 to effect 5, where it is further flashed. From effect 5, the liquor is passed via line 12 to effect 6 for evaporation. The liquor is further evaporated in effects 5, 4, 3, 2 as indicated by line 13. The evaporated liquor in line 14 is withdrawn from effect 2 and fed to effect 1 (not shown), in which the product liquor for burning in a recovery boiler is formed.

BOD (Biological Oxygen Demand) and COD (Chemical Oxygen Demand) load to a waste water treatment plant can be greatly reduced by cleaning and segregating secondary condensate properly within the evaporation system. And when the quality of the secondary condensate is sufficient, all condensate can be used in the mill processes replacing fresh water intake. This remarkably reduces the environmental load.

Thanks to effective droplet separation, secondary condensate from modern evaporators contains very little salts, typically 5-10 mg Na/l for hardwood applications. All volatile components (methanol, total reduced sulfur (TRS)-compounds) from black liquor can be effectively separated from secondary condensate in the evaporator plant.

In modern evaporators secondary condensate can be fractionated inside lamellas to clean and foul condensates fractions (see FIGS. 1 and 2). The generated foul condensate is typically further processed by steam stripping. A stripping process produces stripped (clean) condensate and liquid methanol fuel. Fractionating in each effect is selected to maximize the methanol recovery while minimizing the foul condensate flow. Foul condensate amount from the evaporator plant is typically ca 15% of the total condensate amount and can give an overall methanol recovery of 70-80%. The present (duct stripping) invention can help to increase the methanol capture close to 100% when combined with evaporators that have internal condensate segregation. The condensate segregation is described below.

The vapor space inside the lamellas 20 is divided by diagonal welding seams 21 to lower 22 and upper 23 sections (FIG. 2). Most of the water vapor fed to the evaporator through line 28 is condensed in the lower section producing clean condensate 24. A smaller fraction of the vapor together with most of the methanol and TRS-compounds is condensed in the upper section 23 and collected as foul condensate 25. The foul condensate section area is 5-30% of the lamella surface, the highest in back end evaporator effects. Vent vapor is discharged from conduit 26. Liquor to be evaporated is introduced through line 29 and evaporated liquor is discharged via line 30. Vapor generated in the evaporator is taken out via line 31.

Fractionating in each effect is selected to maximize the methanol recovery while minimizing the foul condensate flow. The foul condensate amount from the evaporator stages is normally varying from 5 to 30% of the total condensate. In the evaporator shown in FIG. 2, the portion of the foul condensate is 10% of the total vapor flow in and its MeOH mass flow out stands for 80% of the total mass flow in of MeOH. The corresponding figures of the clean condensate out are 89% of total vapor mass flow in and the MeOH flow out equals 10% of total mass flow in of MeOH, and the vent vapor is 1% of total vapor mass flow in and its MeOH mass flow out stands for 10% of total mass flow in of MeOH.

Depending on condensate quality and methanol recovery requirements, the number of segregating effects and segregation area can be freely selected in evaporators. Secondary condensate fractions in a 6-effect evaporator are shown in FIG. 1. The 6-effect evaporator shown in FIG. 1 has segregation in effects 2 through 6 and in the surface condenser. Corresponding condensate flows and compositions are indicated in Table 1.

In FIG. 1 the foul condensates formed in effects 2, 3, 4, 5 are collected into a flash tank 17 and discharged through line 18. The foul condensates (FC) from the surface condenser 8 and effect 6 are also led to line 18. The clean condensates from effects 2, 3 and 4 are discharged through line 19 as secondary condensate 1 (SC1). The clean condensates from effects 5, 6 and the surface condenser 8 are discharged through line 27 as secondary condensate 2 (SC2).

Foul condensates are typically cleaned with steam in a stripping column (stripper), which is a cylindrical vessel where the liquid for stripping flows down by gravity and steam rises upward. The mass transfer process is enhanced by intermediate bottoms in the column that divide the heating and degasification of the liquid in stages. The foul condensate stripper is placed between evaporation effects 1 and 2 or 2 and 3. Secondary vapor from a previous effect is used as a heat source in the stripper. The succeeding effect has a dedicated lamella package where vapor from the top of the stripper, enriched with MeOH and TRS-compounds, is partly condensed (inside) and black liquor evaporated (outside). Non-condensed vapor is further partially condensed in a liquor preheater and the rest of stripper gases flow through a trim condenser. The MeOH content in Stripper Off Gases (SOG) is adjusted to about 30% if the gases are further processed into liquid methanol, or to approximately 30 to 50% if the gases are incinerated in a gas phase. The stripped clean condensate from the stripper bottom can be combined with clean secondary condensate.

Stripper off gases can be fired (in a dedicated non-condensable gas incinerator/lime kiln/recovery boiler) or rectified in a methanol column to liquid methanol. Liquefied methanol which can be stored and then fired in a controlled fashion has normally a water content of ca 20% and is a good fuel giving ca 15 MJ/kg.

Integrated foul condensate stripping has a major advantage over alternative systems: all energy required to clean the foul condensate can be utilized in the evaporator and stripping does not appreciably decrease the evaporator economy.

TABLE 1

Condensate quality from the evaporator in FIG. 1.

| | Flow % of total condensate | Methanol mg/l | TRS mg/l | Remarks |
|---|---|---|---|---|
| SC1 | 41 | 25 | <5 | |
| SC2 | 44 | 425 | <10 | Slightly odorous |
| FC foul condensate | 15 | 6000 | <200 | Malodorous |
| Stripped foul condensate | 15 | 300 | <5 | Stripper MeOH purification efficiency = 95% |

Internal and external segregation is combined in some known processes. Honkanen et al. patented a method in U.S. Pat. No. 6,797,125, where foul condensates from a previous effect are flashed in a stripper. The pure condensate fraction from evaporator D is purified in the stripper by the flashed vapors and the resulting high purity condensate fraction is taken out from the bottom of the stripper.

Olausson et al. (6) presented a following method in U.S. Pat. No. 6,258,206. In an evaporator train, where internal segregation is used, foul condensate fraction from effect 1 is fed to the upper part of the steam side of the effect 2. The clean condensate fraction from effect 3 is circulated to the lower part of effect 2 steam side. MeOH and other VOC's are concentrated into the dirty fraction from the last effect. When condensates of different purity are fed into the steam side, the least contaminated condensate is first stripped by the clean secondary vapor, which collects impurities but is still capable of purifying the more contaminated condensate in the upper part of the heat transfer section.

The most fouled condensate fraction is routed into a condensate treatment plant. A condensate treatment plant is typically integrated with the evaporator train, and it comprises a stripping column, a 2-effect evaporator, a MeOH-liquefaction column and a terpene decanter.

In a typical arrangement presented in FIG. 10, foul condensate in line 200 is first preheated in a preheater 202 with stripped condensate in line 206 from the bottom of the stripping column 204. A stripping column 204 is a tray-column, where typically secondary vapor from effect 1 in line 228 is used to remove impurities from the condensate. Contaminated stripper overhead vapor 208 is used for heating the second effect 210 in a separated heat transfer section, and condensate is flashed and recycled back to the stripping column via line 212 as a reflux. Non-condensable gases (NCG) from the second effect's separated heat transfer area can be used for preheating (in a preheater 214) liquors between effects 2 & 3. All the NCG's and flashed vapors are finally routed to a trim condenser 216, where the final condensation is done by cooling water in line 218. The resulting condensates in line 230 are mixed with the stripper reflux stream. The NCG's from the trim condenser 216 can be combusted in the recovery boiler, in the lime kiln or in a dedicated NCG incinerator. Another option is to strip NCG's (in line 220) with vapor 238 in a MeOH column 222. The overhead vapor 232 from the MeOH column is partially condensed in condenser 224 with cooling water 240 to liquid MeOH, which is taken out via line 236. Terpenes can be separated in a terpene decanter in softwood plants. The bottom stream from the MeOH column and condensed overhead vapors from the condensate stripper can be fractioned in a decanter system.

BRIEF DESCRIPTION OF THE INVENTION

There is a desire to improve separation of contaminants, such as methanol and TRS, from liquid flows, such as evaporation condensates, or vapor flows at an evaporation plant. The new method and arrangement can be practiced at a pulp mill, but they are not limited thereto. An objective of the invention is to enhance the separation of contaminants, by stripping of contaminants such as methanol and TRS, from liquid (secondary condensate) in droplets or liquid film into evaporation vapors by optimizing the net mass and heat transfer in a vapor duct. It has been found that this can be done by spraying liquids, such as secondary condensates, into evaporator vapor streams. The liquid cleaned by the new method is called a duct stripped liquid.

Stripping of liquid in a vapor duct is more favorable than treating secondary condensate directly in a stripper column, at least in such cases when there is a need to pre-treat e.g. large flows of secondary condensate, or when the duct-stripped secondary condensate flow can be used directly as a hot fresh water replacement, or when duct-stripped condensate is added to a cleaner secondary condensate fraction which is so clean that it does not at all need to be treated in the stripper column. Duct-stripping is hence primarily used to minimize the flow of foul condensate or secondary condensates to the stripper column, which in turn minimizes the heat energy consumption of the stripper column. Duct-stripping can also be used for producing clean condensate that can be used as replacement for hot fresh water.

According to the inventive method of the present invention contaminants are separated from liquids by means of stripping by bringing a liquid into a direct contact with a vapor at an evaporation plant, so that a contaminated liquid is sprayed into vapor flowing in a vapor duct, thus reducing the contaminant content of the sprayed liquid and producing a cleaned liquid such that contaminants are enriched in the vapor. The cleaned liquid is collected from a process point of view in the most beneficial part of the vapor duct. The described enrichment of contaminants in vapor is called stripping.

According to the inventive method of the present invention contaminants are separated also from vapors by bringing a liquid into direct contact with a contaminated vapor at an evaporation plant by spraying or distributing a contaminant-leaner liquid into the vapor flowing in a vapor duct or onto wall surfaces of the duct thus increasing the contaminant content of the sprayed liquid and producing a cleaned vapor, and collecting the contaminant-enriched liquid. The described enrichment of contaminants in liquid is called absorption. Particles and/or carry-over components, such as acids and alkalis, can be separated from vapors.

The inventive arrangement is disclosed for purification of liquids or vapors at an evaporation plant having at least one evaporator vessel equipped with a vapor duct. According to a preferred embodiment the vapor duct is provided with a device for spraying or distributing a liquid into the vapor flowing in the vapor duct or onto wall surfaces in the vapor duct in order to bring the liquid into direct contact with the vapor thus reducing the contaminant-content of the liquid or the vapor.

A vapor duct is a duct which is connected to an evaporator and through which vapor formed in the evaporator is led out. The duct can be arranged so that the vapor is led to another evaporator vessel, back to the same evaporator or to a further process stage. Separation of contaminants, either by stripping or absorption, can be enhanced by prolonging the residence time of the liquid, such as condensate, in the duct. Separation is favored when the vapor duct gas volume and the wet area (i.e. droplet area+film area) is as large as possible. This means that some evaporator applications can be more suited for duct stripping than others. Other important variables affecting separation efficiency are spray properties and direction of secondary condensate.

Separation of contaminants can be enhanced by heating the sprayed liquid to saturation temperature or 5 to 10° C. above saturation temperature of the vapor before spraying.

In the novel method different kinds of contaminants can be separated from liquids. According to a preferred embodiment the contaminants are methanol and/or TRS (total reduced sulphur) compounds, which are common volatile contaminants in condensates at a pulp mill. Typically said liquid to be sprayed is condensate and said contaminants are at least one of methanol and TRS.

A contaminated liquid, such as methanol or/and TRS enriched liquid, can be sprayed either co-currently to the vapor flow or countercurrently to the vapor flow in the vapor duct, or any other direction compared to the vapor flow. Countercurrent gives often higher separation.

According to an embodiment of the invention a contaminant (methanol and/or TRS)-enriched condensate is formed in a multi-effect evaporation plant, and the condensate is sprayed into a vapor duct from the same evaporator where the condensate comes from, or from a preceding or a succeeding evaporator. A contaminated liquid, such as methanol or/and TRS-enriched liquid, can be cleaned both in evaporator processes that are multi-effect plants or single effect plants like vapor recompression plants run by a fan or steam ejector.

The cleaned liquid can be used as replacement liquid for fresh water within the mill.

The method according to the present invention is applicable to all known evaporator applications.

In the present method contaminated liquid or vapor can be treated both at low pressure or elevated vapor pressure.

Preferably the collection point of the cleaned/contaminated liquid (such as condensate) in vertical vapor ducts is located after a curve at the bottom of the vapor duct outlet.

A contaminant-enriched liquid can also be waste liquors coming from any wood-based pulping process, or waste liquors or effluent streams (such as a sludge stream) coming from any biomass process.

Duct stripping can be used to clean waste liquor condensate contaminants from any biomass-based pulping process. The novel method can also be used as a method of absorbing contaminants from a contaminated vapor flow at an evaporation plant of any biomass process producing fuel, food or chemicals. The arrangement for carrying out of the novel method can be easily installed in both new and existing evaporation plants. The main components are some additional pipe lines and connections for leading liquid to a suitable vapor duct.

The liquid is preferably supplied via a feed pipe which extends through the vapor duct wall to the vapor duct and which is provided with at least one nozzle so that the liquid is sprayed as drops to the vapor flow. In case there are several nozzles, they are evenly distributed over the width of the duct. The liquid can also be sprayed via openings in the form of nozzles which are arranged for supplying liquid from the inner wall of the duct around the duct. The liquid can also be fed through such openings in the duct wall, whereby the liquid is distributed to the duct so that it flows as a film along the inner wall of the duct. The openings are arranged around the duct periphery.

Crucial variables for a well working duct stripping or absorption system are the mass flow of vapor and dirty (or clean) condensate ($m_6$, $m_3$), pressure drop over the spray nozzle (p3-p5), nozzle characteristics, (i.e. spray geometry (hollow cone or full cone), droplet size distribution (average diameter), opening angle of spray ($\alpha$), velocity of the droplets ($w_d$)), droplet temperature and vapor saturation temperature (T3, p6), droplet and vapor velocity ($w_d$, $w_v$), residence time in the duct ($\tau$), duct geometry, vapor and liquid equilibrium (x and y), interfacial equilibrium (net mass transfer of water vapor or not, this influences the methanol transport), heat and mass transfer both inside the droplet and on the duct walls (influences net mass transfer of water vapor), see Table 2 and FIG. 3 for nomenclature. Favorable operation is obtained when using commercial nozzles producing droplets smaller than 5 mm and opening angles from 20° to 180°. Separation is further favored when the vapor duct gas volume and the wet area (=droplet area+film area) is as large as possible. Suitable nozzle size and number of nozzles depend on the size of the process as well as on the volume flow of the sprayed liquid.

The film area in the duct can be increased with internal duct elements. The film area can be increased, for example, with a pipe inside the vapor duct. The internal duct element has a simple structure. It does not have a considerable effect on the flow patterns of liquid or gas, or cause a considerable pressure loss. No fill elements which are used in packed towers are used, but the cross-section of the vapor duct is essentially free for the vapor flow.

TABLE 2

Crucial process variables; see FIG. 3 for their locations

| | |
|---|---|
| S3, m3 | Dirty (or clean condensate) from the nozzle pump |
| S4 | CC, Clean condensate from x + 1-effect lamella |
| S5, T5, p5 | Sprayed condensate before x + 1-effect lamella |
| S6, p6, m6 | Secondary vapor from x-effect |
| p3, T3 | Sprayed condensate after heating or cooling spraying fluid |
| DSL | Outtake of duct-stripped liquid (gravity and centrifugal forces collects liquid at pipe bottom before inlet to next evaporator) |
| NCG | Non-condensable gazes |
| FC | foul condensate |

It is beneficial to design the duct stripping system so that the net mass transfer rate of methanol is maximized by optimizing the previously listed crucial variables to be as cost effective as possible, still establishing maximum separation, e.g. close to 100% methanol removal, see the example below. A removal close to 100% can be obtained by utilizing this invention.

BRIEF DESCRIPTION OF THE DRAWINGS

The inventive method and arrangements will be described further with reference to the accompanying drawings in which

FIG. 4 is a principal drawing for experimental setup and FIG. 5 shows sample points as well as measurement points of field tests.

DETAILED DESCRIPTION OF THE PRESENT INVENTION

Figure 2:
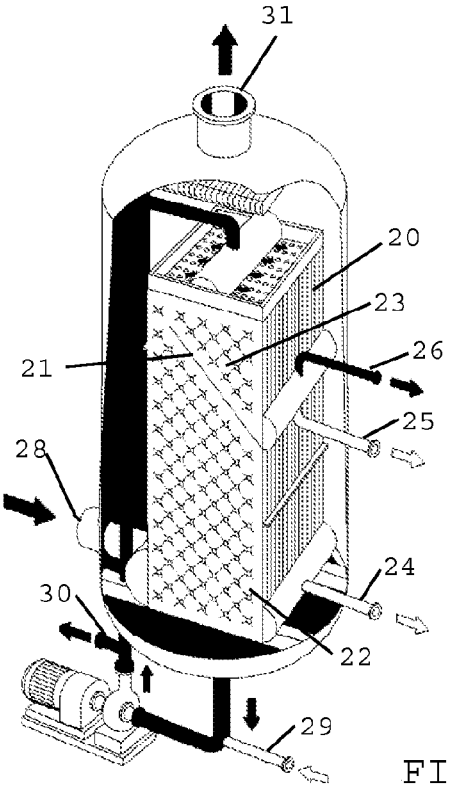
FIG. 2 illustrates the structure of a known lamella evaporator, in which condensate segregation into clean and foul condensate takes place.
Figure 3:
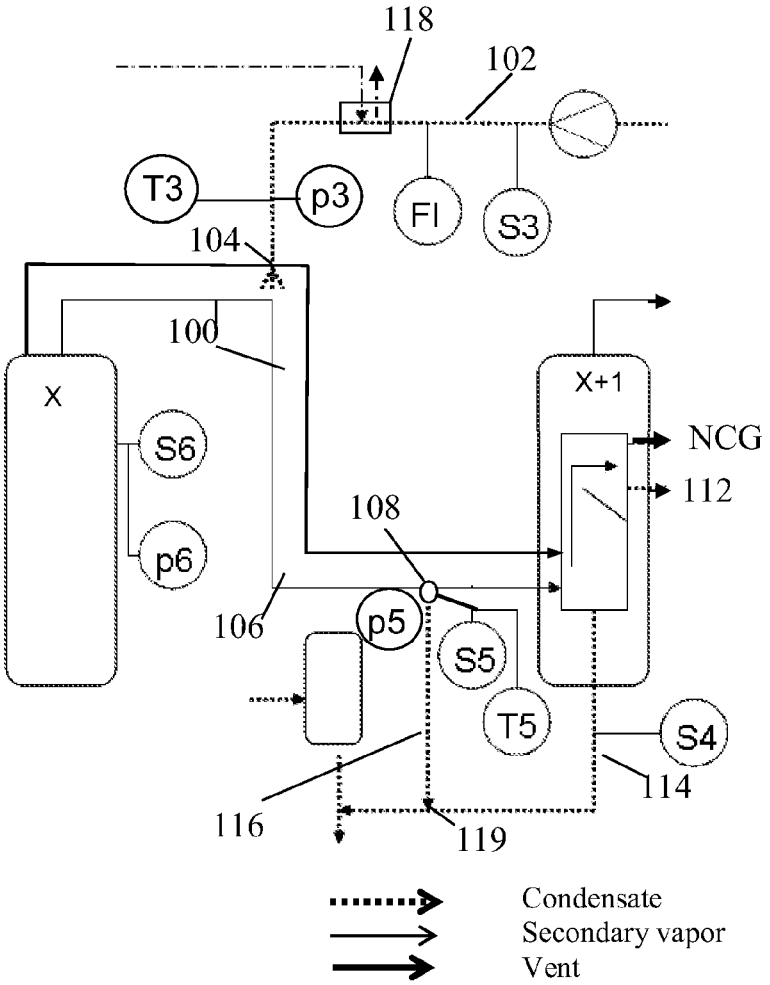
FIG. 3 shows schematically a duct stripping arrangement according to the present invention.

An arrangement for carrying out the novel stripping process is shown in FIG. 3. Effects x and x+1 of a multi-effect evaporation plant are shown. These effects can be, for example, effects V and VI, of the black liquor evaporation plant. Black liquor is evaporated in effect x so that vapor is formed. The vapor is led through a duct 100 to the next effect x+1. Dirty condensate containing methanol and other volatile compounds is led through line 102 and sprayed by means of a nozzle or nozzles 104 to the vapor duct 100. Condensate drops come into direct contact with vapor so that methanol and other contaminants are taken up by the flow of vapor. Cleaned condensate, called duct-stripped condensate, is running downwards along the wall of the vapor duct and is preferably collected after a curve 106 at the bottom 108 of the vapor duct before the inlet of effect x+1. The vapor having an increased content of volatile contaminants flows in the duct 100 to the next evaporation effect x+1 where it is condensed. The heating element of the effect x+1 is a lamella 110 as described in connection with FIG. 2, whereby condensate segregation takes place and clean 114 and foul 112 condensates are formed in the lamella 110. The foul condensate can be further treated in a stripping column plant of the mill. The duct-stripped condensate in line 116 can be pumped from the vapor duct 100 directly to a process where it is used as process water. The duct-stripped condensate and the clean condensate 114 can also be combined, but this depends on their content of contaminants, such as methanol, and optimal use of condensates in a further process.

The foul condensate can be heated directly or indirectly in a heat exchanger 118 before spraying to the vapor duct 100. The heating contributes to the stripping effect in the duct.

Figure 4:
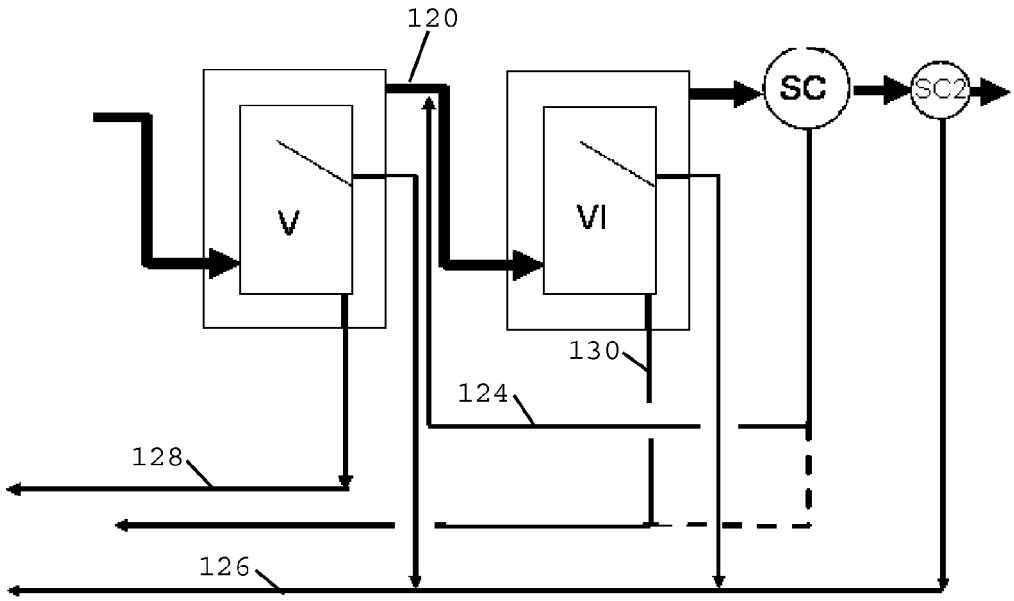
FIGS. 4 and 5 illustrate schematically the test arrangement for the present invention.

Field tests at a full scale pulp mill evaporator plant were carried our. Methanol and COD (chemical oxygen demand) analyses from full scale mill trial with condensate having a high methanol content were performed by VTT Expert Services Oy in Espoo, Finland. MeOH was analyzed with GC-FID gas chromatography and COD with standardized SFS 5504:1988 titration method. MeOH and COD—removals were calculated from the equation:

$$\text{removed_MeOH_or_COD} = \frac{S3 - S5}{S3} \quad [1]$$

where S3 and S5 are analyzed (MeOH and COD concentrations at sample points S3 and S5, see FIGS. 3 and 4). It is assumed that a small change in the droplet mass does not affect the result. None of the experiments exceeded equilibrium removal. The uncertainty of methanol measurement is seen as a bigger variation in removed methanol compared to COD removal.

Figure 1:
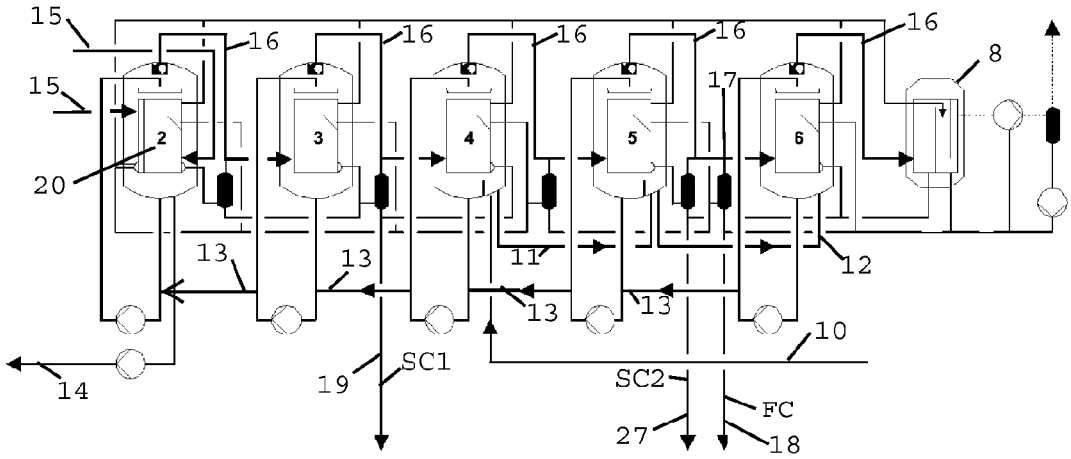
FIG. 1 shows schematically a known multi-effect evaporation plant of black liquor.

FIG. 4 illustrates two black liquor evaporators V and VI. Vapor formed in effect V is led through a vapor duct 120 to effect VI. Condensate SC and SC1 are produced in the surface condenser as described in connection with FIG. 1. The condensate SC is led through line 124 and sprayed to the vapor duct 120. Foul condensate from the evaporation effects and surface condenser are led through line 126 and secondary condensate from effect V through line 128. The duct-stripped condensate is led to effect VI and discharged therefrom together with secondary condensate formed in effect VI to line 130.

Foul condensate was sprayed into a vapor duct from effect V of the black liquor evaporation plant: The test runs were performed at an evaporation plant running on either 80% or 100% capacity. The evaporation plant was kept in steady state during test trials; the test trial process is described in FIGS. 4 and 5.

Figure 5:
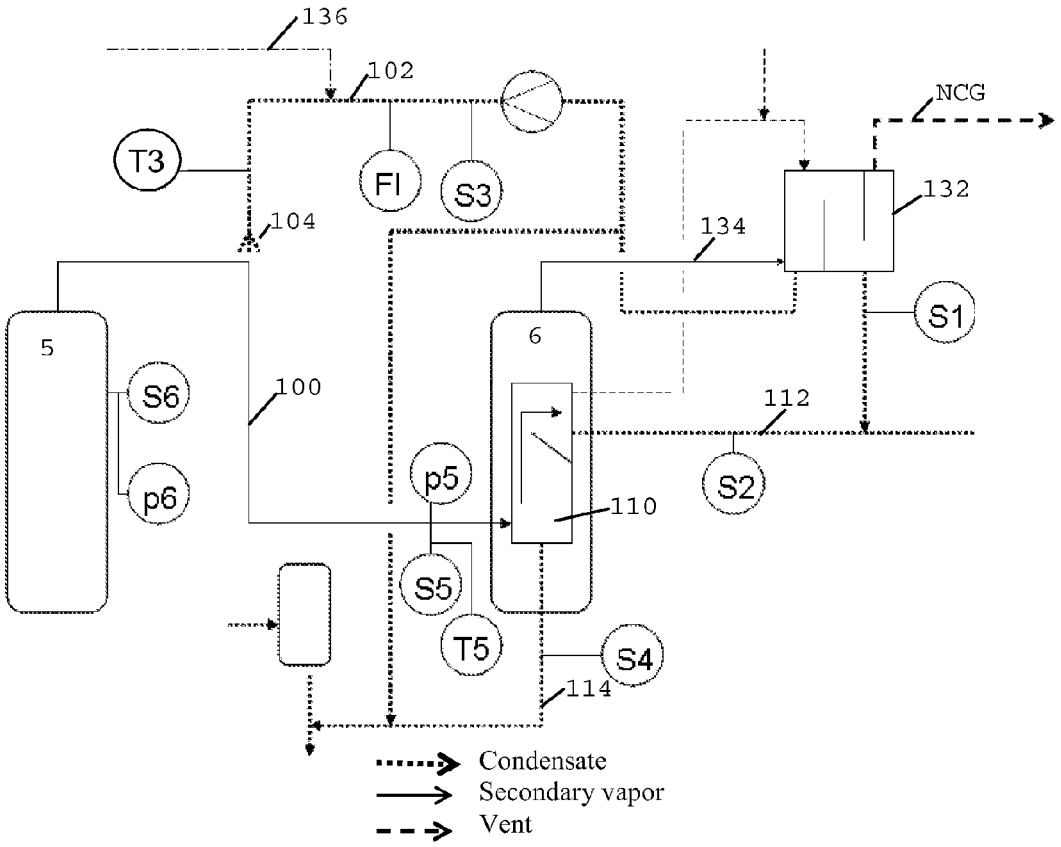

In FIG. 5 effects x and x+1 of a multi-effect evaporation plant of FIG. 3 are shown. These effects are effects V and VI, of the black liquor evaporation plant. Black liquor is evaporated in effect 5 so that vapor is formed. The vapor is led through a duct 100 to the next effect 6. Foul condensate containing methanol and other volatile compounds from a surface condenser 132 where vapor in line 134 from effect 6 is condensed is led through line 102 and sprayed by means of a nozzle or nozzles 104 to the vapor duct 100. Condensate drops come into direct contact with vapor so that methanol and other contaminants are taken up by the flow of vapor. Cleaned condensate, called duct-stripped condensate, is running downwards along the wall of the vapor duct 100 and is preferably collected through the bottom of the effect 6. The vapor having an increased content of volatile contaminants flows from the vapor duct 100 into the heating element of the next evaporation effect 6 where it is condensed. The heating element of the effect 6 is a lamella 110 as described in connection with FIG. 2, whereby condensate segregation takes place and clean 114 and foul 112 condensates are formed in the lamella 110. The foul condensate in line 112 can be further treated in a stripping column plant of the mill. The duct-stripped condensate is led to effect 6 and further together with the vapor condensate from the succeeding evaporator 6 through line 114 to a process where it can be used as process water.

The foul condensate can be heated directly in line 102 by adding steam from line 136 before spraying to the vapor duct 100. The heating contributes to the stripping effect in the duct.

Sampling locations and measurements for FIG. 5 are presented in table 3.

TABLE 3

| Sampling- & measurement locations shown in FIG. 5 | |
|---|---|
| Sample 1 | Foul condensate from surface condenser |
| Sample 2 | Foul condensate from 6 effect lamella |
| Sample 3 | Condensate from the pump |
| Sample 4 | Clean condensate from 6-effect lamella |
| Sample 5, T5, p5 | Sprayed condensate before 6-effect lamella |
| Sample 6, p6 | Secondary vapor from 5-effect before droplet separator |
| T3 | Sprayed condensate after heating of spraying fluid |
| U pipe (second runs) | dp measurements between p5 & p6 |
| S7 (second runs) | secondary condensate 2 |
| S8 (second runs) | foul condensate |

Figure 6:
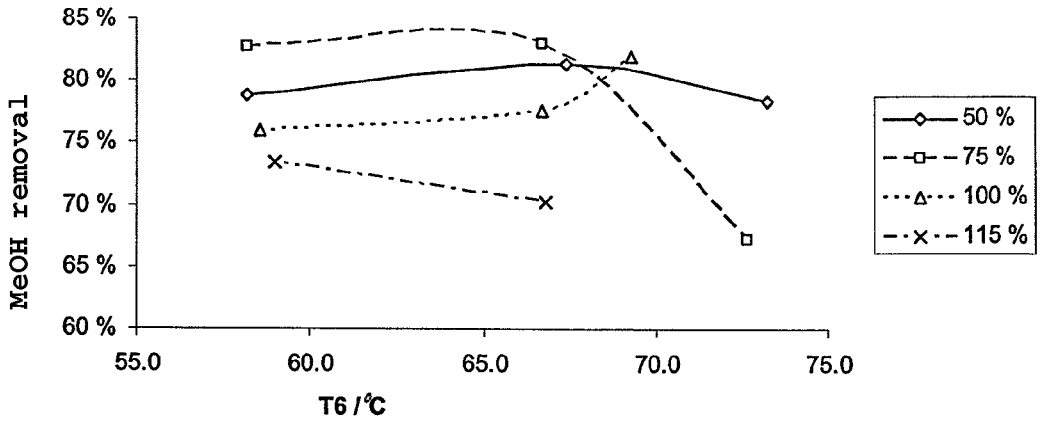
FIGS. 6-9 show test results of the present invention.
Figure 7:
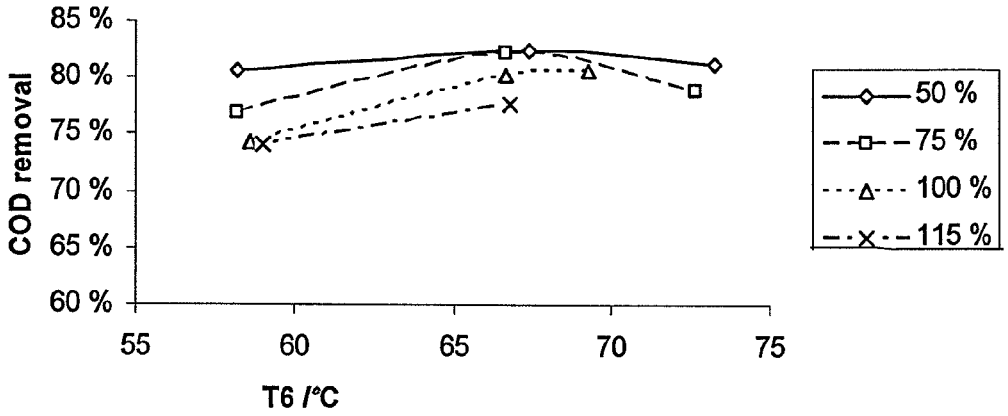

The test results are presented in FIGS. 6-9. FIGS. 6 and 7 show methanol and COD removal at different condensate temperatures (° C.) when the evaporation plant is running at 80% capacity. FIG. 6 shows methanol removal when the evaporation plant is running at 80% capacity, the parameter is the ratio of secondary condensate flow rate to vapor rate. FIG. 7 shows COD removal when the evaporation plant is running at 80% capacity, the parameter is the ratio of secondary condensate flow rate to vapor rate.

Figure 8:
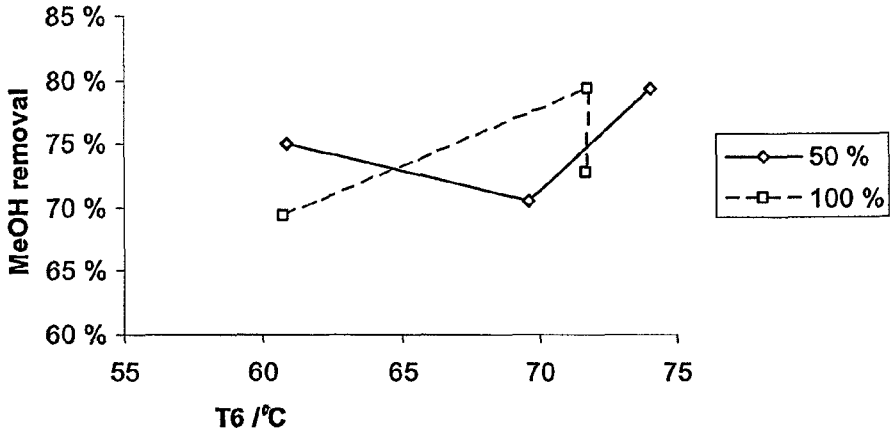
Figure 9:
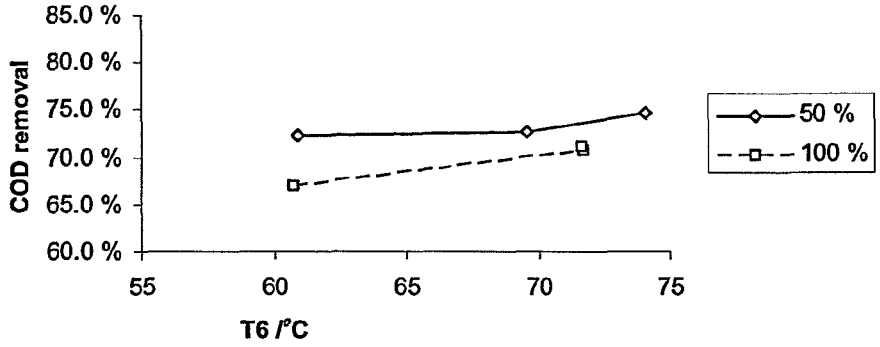
Figure 10:
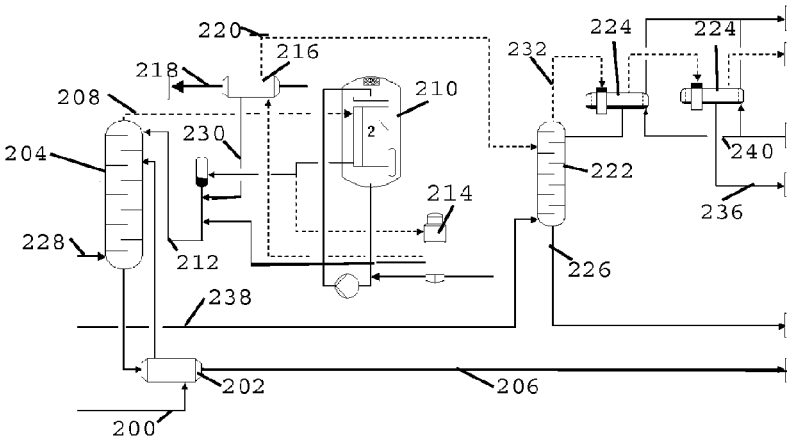
FIG. 10 illustrates an integrated foul condensate stripper and liquid methanol plant.

FIGS. 8 and 9 show methanol and COD removal at different condensate temperatures (° C.) when the evaporation plant is running at 100% capacity. FIG. 8 shows MeOH removal when the evaporation plant is running at 100% capacity, the parameter is the ratio of secondary condensate flow rate to vapor rate. FIG. 9 shows COD removal when the evaporation plant is running at 100% capacity, the parameter is the ratio of secondary condensate flow rate to vapor rate. The legend parameter 100%, in FIGS. 6 to 9 means that sprayed condensate mass flow is equal to the mass flow of water vapor from effect 5, at either 80% or 100% evaporation plant capacity. Similarly, legend names (50%, 75%, 115%) in FIGS. 6 to 7, mean that the ratio of sprayed condensate mass flow to the mass flow of vapor from effect 5, is (50%, 75%, 115%) when the evaporation plant capacity is 80%.

According to the results, removals from heated condensate ("hot" spray) are higher than those from cold spray condensate. This is because "equilibrium" or "hot" spray condensates have more vapor to which they can donate their MeOH and less net mass transfer of water vapor to overcome, see FIGS. 6 to 9. Lower removal rates at 100% evaporation capacity are caused by a smaller reactor volume (droplets are carried by the fast flowing vapor) and a smaller wetted wall area giving a shorter residence time, x, for the sprayed condensate.

Figure 11:
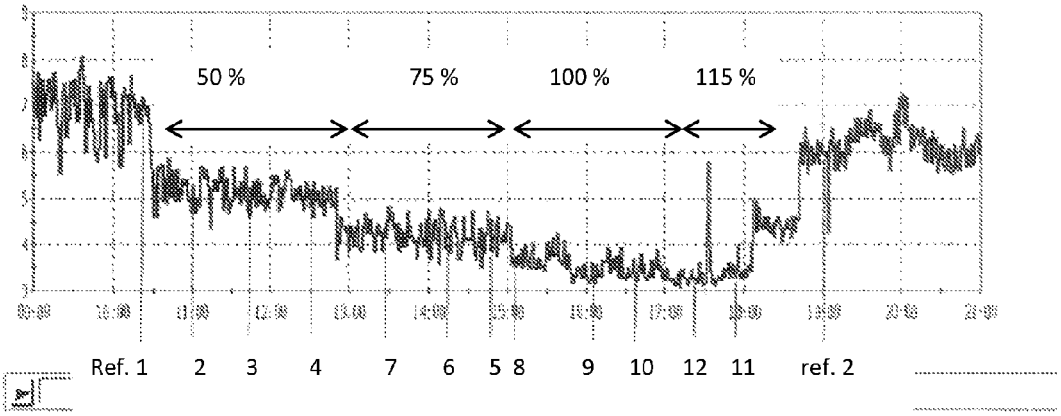
FIG. 11 shows conductivity test results of secondary condensate 2, at 80% evaporation capacity.

Conductivity trends during test runs: Conductivity data was gathered from the plants total secondary condensate stream during the tests at 80% evaporation capacity, see FIG. 11. A recorded change in conductivity then is mainly caused by a change in TRS compounds, which are more conductive than MeOH. It can be seen that the conductivity of secondary condensate 2 decreases immediately after the spraying is started (at point "Ref 1") and continues to decrease when the spraying volume is increased from 50% to 115% flow (the spraying was stopped at point "Ref 2"). Points 2 to 11 are therefore trial run numbers for a set of field tests where the ratio of secondary condensate to vapor flow and the temperature of the sprayed secondary condensate varies. The change in conductivity was therefore checked in a later test trial when running the evaporation plant at 100% capacity. Laboratory measurements of TRS removal from the vapor duct field tests were calculated to be more than 95%, when the evaporation plant was run at 100% capacity.

The upper part of evaporators is typically equipped with a drop separator. When contaminated vapor is formed in an evaporator and led through a vapor duct of the evaporator, a contaminant-lean liquid is sprayed into the vapor flow for separating detrimental particles and components from the vapor. This may contribute to or even replace the operation of the drop separator, at least to some extent.

Important factors increasing duct stripper function:

A) Importance of the liquid film on the duct surfaces (wall film) and the formation of the wall film (starting point of film).

B) Droplet size reduction is increased when spraying countercurrently to a high velocity vapor flow.

C) Shorter residence time in vapor duct at increasing evaporation capacity lowers removal efficiency.

The novel separation method of the present invention secures cleaner secondary condensates by spraying methanol or/and TRS-enriched condensates into vapor ducts and collecting the clean condensate either from the vapor duct bottom before the evaporator or together with evaporator clean condensate.

Field measurements have shown that methanol removal efficiency of a duct stripper can have mill-wide effects on MeOH segregation. Measured duct stripper separation in a full scale plant has been proven to be ca 70% to 90%. This makes it possible to increase the methanol recovery by 1-3 kg methanol/ton pulp. This method could hence in Finland increase methanol recovery to methanol fuel by many millions of tons per year. Thereto odor releases decrease as well as a need to use fresh raw water in such places where the use of odorous condensates is not allowed, e.g. at a lime mud filter at the causticizing plant of the pulp mill. This method makes it hence possible to decrease fresh water consumption and heating of fresh water to process temperature. It can thus also help to reduce the flow of effluent and the corresponding effluent treatment costs. Duct stripping is a cost-effective method and can motivate segregation system investments which in some cases can be as high as 1 euro/t pulp when looking at a one year pulp production, i.e. 1000000 t pulp/year could motivate an overall investment into the condensate segregation system of 1,000,000 euro.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. The present invention is described above in more detailed in connection with black liquor evaporation in lamella evaporators. The present invention, in which liquid is sprayed to vapor in a vapor duct, is applicable to all known kind of evaporators. The evaporator process can be carried out in a multi-effect evaporation plant or a single evaporator effect plant such as a vapor recompression plant run by a fan or steam ejector.

The invention claimed is:

1. A method for purification of liquids or vapors at an evaporation plant, the method comprising:

generating vapor in an evaporator vessel and ducting the vapor to a vapor duct connected to the evaporation vessel;

spraying or distributing a liquid into the generated vapor as the vapor flows through the vapor duct or onto wall surfaces in the vapor duct;

separating in the vapor duct contaminates from at least one of the liquid or the vapor by transferring the contaminates between the liquid and the vapor to form a mixture liquid and a mixture vapor, wherein the mixture liquid is separate from the mixture vapor;

separating the mixture liquid and the mixture vapor; and after the separation for the mixture vapor from the mixture liquid, feeding the mixture vapor to a vapor treatment device.

2. The method according to claim 1, wherein the mixture liquid is discharged from at least one of the vapor duct or the evaporator vessel.

3. The method according to claim 1 wherein the separation of the mixture liquid and the mixture vapor is performed in an extended region of the vapor duct.

4. The method according to claim 1, further comprising heating the liquid to at least a saturation temperature of the vapor before the spraying or distribution of the liquid into the vapor.

5. The method according to claim 1 wherein the liquid includes methanol or total reduced sulfur (TRS), and the separation includes transferring the methanol or TRS from the liquid to the mixture vapor.

6. The method according to claim 5 further comprising collecting the methanol or TRS from the mixture vapor.

7. The method according to claim 5 further comprising separating the methanol or TRS from the mixture vapor in an evaporator or condenser of the vapor treatment device.

8. The method according to claim 1 wherein said liquid includes a condensate containing at least one of methanol and TRS.

9. The method according to claim 1 further comprising using the mixture liquid as fresh water within a mill associated with the evaporation plant.

10. The method according to claim 1 wherein the vapor duct includes a vertical section and a liquid drain at an elevation below the vertical section, and the method includes draining the mixture liquid through the liquid drain from the vapor duct.

11. The method according to claim 1 wherein the liquid includes waste liquor condensate produced by a biomass-based pulping process associated with the evaporation plant.

12. The method according to claim 1 wherein the vapor includes contaminants produced by a biomass-based pulping process associated with the evaporation plant.

13. The method according to claim 1 wherein the spraying or distributing includes spraying the liquid from or through a surface of the vapor duct.

14. The method according to claim 1 wherein the spraying or distributing includes spraying the liquid into the vapor duct from spray nozzles.

15. The method according to claim 1 further comprising collecting the mixture liquid on internal surfaces of the vapor duct.

16. An assembly for purification of liquids or vapors at an evaporation plant having at least one evaporator vessel or condenser equipped with a vapor duct, wherein the assembly comprises:

generating vapor in an evaporator vessel of the at least one evaporator vessel and ducting the vapor from the evaporator vessel to a vapor duct connected to the evaporation vessel;

a device for spraying or distributing a liquid into vapor flowing through the vapor duct or onto wall surfaces in the vapor duct;

a drain in or adjacent the vapor duct for separating a mixture liquid formed by mixing the liquid and vapor in the vapor duct, and a coupling for the vapor duct downstream of the drain and connecting a vapor discharge end of the vapor duct to a second one of the at least one evaporator vessel or condenser.

17. The assembly according to claim 16, wherein the device comprises a feed pipe which extends through the vapor duct wall to the vapor duct and which is provided with at least one nozzle for spraying the liquid.

18. The assembly according to claim 16, wherein the device comprises openings in the wall surfaces of the vapor duct and the liquid is distributed through the openings into the vapor duct.

19. The assembly according to claim 16 wherein the vapor duct is connected to a conduit for removing the liquid.

20. The assembly according to claim 19, wherein a conduit is connected to the vapor duct at a liquid collection point at a bottom of a vertical duct section of the vapor duct.

21. The assembly according to claim 16 wherein the at least one evaporator vessel or condenser is connected to a condensate system of the evaporation plant for leading condensate to the vapor duct.

22. A method to purify fluids in an evaporation plant including a vapor duct, the method comprising:

generating vapor in an evaporation vessel and ducting the vapor to an inlet to the vapor duct, wherein the vapor duct is connected to the evaporation vessel;

injecting a liquid into the vapor flowing through the vapor duct;

as the vapor and injected liquid interact in the vapor duct, contaminates from the vapor or injected liquid are transferred to a resulting mixture liquid or mixture vapor;

separating in the vapor duct the mixture liquid from the mixture vapor in the vapor duct, and after separating the mixture liquid, transporting the mixture vapor from the vapor duct to a vapor treatment device in the evaporation plant.

23. The method of claim 22 wherein the injection of the liquid includes spraying the liquid into the vapor flowing through the duct, and the mixture liquid forms as condensation on interior surfaces of the vapor duct.

24. The method of claim 22 wherein the injection of the liquid includes forming a film of the injection liquid on interior surfaces of the vapor duct and the mixture vapor includes volatile components evaporated from the film.

25. The method of claim 22 wherein the injection of the liquid includes spraying of the liquid through a nozzle coupled to the vapor duct, wherein the nozzle is fluidly coupled to a source of the liquid to be sprayed.

26. The method of claim 22 wherein the vapor duct includes a vertical section downstream of the injection of the liquid and the removing of the mixture liquid includes draining the mixture during liquid from a bottom of the vertical section.

27. A method for purification of liquids or vapors at an evaporation plant, the method comprising:

introducing vapor from an evaporator vessel in the evaporation plant to a vapor duct, wherein the vapor duct is connected to the evaporator vessel;

spraying or distributing a liquid into the vapor flowing through the vapor duct or onto wall surfaces in the vapor duct;

separating in the vapor duct contaminates from at least one of the liquid or the vapor by transferring the contaminates between the liquid and the vapor to form in the vapor duct a mixture liquid and a mixture vapor;

separating the mixture liquid and the mixture vapor, and after separating the mixture liquid, transporting the mixture vapor to a vapor treatment device in the evaporation plant.

* * * * *